United States Patent [19]

Morgans

[11] 4,201,599

[45] May 6, 1980

[54] RESTORATION AND PROTECTION OF CUTTING SURFACES

[76] Inventor: Trevor Morgans, c/o Kaplan & Stratton Advocates, P.O. Box 40111, Queensway House, Kaunda St., Nairobi, Kenya

[21] Appl. No.: 922,312

[22] Filed: Jul. 6, 1978

[51] Int. Cl.[2] ..... C23F 9/02

[52] U.S. Cl. ..... 148/6.14 R; 30/346; 30/346.5; 30/346.53; 106/14.15; 252/390

[58] Field of Search ..... 260/564 C, 565; 148/6.14 R; 30/346, 346.5, 346.53; 252/390, 391, 392; 106/14.15

[56] References Cited

U.S. PATENT DOCUMENTS

| | | | |
|---|---|---|---|
| 2,684,924 | 7/1954 | Rose et al. | 260/565 X |
| 2,734,807 | 2/1956 | Chenicek et al. | 252/390 |
| 2,776,917 | 1/1957 | Shnitzler et al. | 148/6.14 R |
| 3,909,200 | 9/1975 | Redmore | 252/390 |
| 4,059,624 | 11/1977 | Harrison | 260/565 |

OTHER PUBLICATIONS

Chemical Abstracts, 9th col. Index, 1972–1976, pp. 37568cs–37570cs.

*Primary Examiner*—Ralph S. Kendall
*Attorney, Agent, or Firm*—Browdy and Neimark

[57] ABSTRACT

A method of restoring and/or protecting a cutting surface so that it has an increased effective life comprises applying to the cutting surface a chlorhexidine compound dispersed or dissolved in a carrier therefor. Novel compositions for use for this purpose comprise solutions or suspensions of chlorhexidine compounds in suitable carriers, preferably together with cationic surfactants.

37 Claims, 10 Drawing Figures

RESTORATION AND PROTECTION OF CUTTING SURFACES

Figure 1:
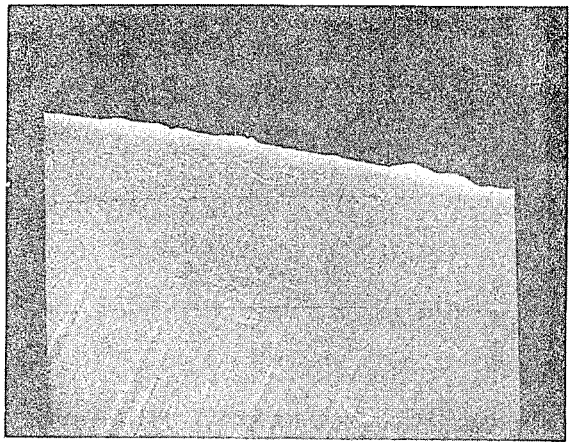

This invention relates to a chemical method of restoring and protecting the cutting surfaces of cutting devices and to a composition for use therein.

Hitherto, a variety of methods have been employed for protecting cutting edges against abrasion and thereby attempting to prolong the useful life thereof. This has been particularly the case with cutting edges of razor blades with which, in recent years, coatings of platinum and chromium have been employed.

Moreover, coatings of polytetrafluoroethylene have been employed as means of reducing friction. In addition, in an attempt to provide longer lasting cutting edges, carbon steel employed for many years as the material of razor blades has come to be largely replaced by stainless steel.

However, despite these various measures, the effective life of a razor blade has generally only been improved by a factor of up to about 5.

It is an object of this invention to provide an improved method of increasing the wear resistance of a cutting device.

It is a further object of the invention to provide a means of restoring and cleaning a blunt cutting surface.

In furtherance of these objects, this invention provides a method of restoring and/or protecting a cutting surface which comprises applying to the cutting surface a chlorhexidine compound dispersed or dissolved in a carrier therefor for a predetermined time period.

This invention also provides a method of restoring and/or protecting a used cutting surface which comprises bringing the cutting surface into contact with a solution or dispersion of a chlorhexidine compound, which solution or dispersion has dissolved therein a surfactant.

This invention also provides a composition effective in the restoration and/or protection of cutting surfaces which comprises a chlorhexidine compound dissolved or dispersed in a carrier therefor, the carrier additionally containing dissolved therein a surfactant.

This invention is based upon an observation which has been made that chlorhexidine and its salts, when applied to cutting surfaces have the surprising beneficial effect of restoring cutting ability to the cutting surface if it is bluntened or of protecting an already sharp cutting surface against future wear. This behaviour has not hitherto been recorded and is believed to be due to the formation of an extremely thin lath-like structure resulting from interaction between the chlorhexidine compound and the metal surface with apparent formation of a unimolecular layer of a product formed by interaction between the chlorhexidine compound and the metal surface brought into contact therewith. This has been confirmed by electron microscopy and stereoscans. The nature and construction of these laths is not understood and is being investigated at the present time. It is believed that the lath-like structure which is hard and abrasion resistant intermeshes with the crystalline structure of the metal to provide the protection and restoration thereof.

The chlorhexidine compound may be employed in the form of an aqueous solution in which the metal cutting surface is immersed or alternatively may be incorporated in a gel or cream applied to the cutting surface and allowed to stand thereon, when it exerts an inhibitory effect on oxidation. The chlorhexidine compound can be used in extremely low concentrations, and will usually be present in 0.001 to 3% by weight concentration, the concentration depending upon the physical form of the chlorhexidine compound, compounds in solution interacting more readily with the metal cutting surface than compounds only in dispersion and the concentration of chlorhexidine compounds depending on its solubility in the medium employed.

Chlorhexidine, which is the common name for 1,6-di-(4-chlorophenyldiguanido) hexane has been employed to useful effect in the treatment of metal cutting surfaces as a wide variety of its salts. Salts which have been employed are the following: the dihydriodide, dihydrochloride, dihydrofluoride, diperchlorate, dinitrate, dinitrite, sulphate, sulphite, thiosulphate, di-acid phosphate, difluorophosphate, diformate, diacetate, diproprionate, diisobutyrate, di-n-yalerate, dicaproate, malonate, succinate, malate, tartrate, dimonoglycolate, monodiglycolate, dilactate, di-α-hydroxyisobutyrate, digluconate, diglucoheptonate, dimethanesulphonate, di-isothionate, dibenzoate, dicinnamate, dimandelate, di-isophthalate, di-2-hydroxynaphthoate, and embonate. The digluconate, diacetate and dihydrochloride compounds are particularly readily available commercially and of these, the digluconate, usually termed simply chlorhexidine gluconate, has been found to be particularly effective because of its good solubility in water. Aqueous chlorhexidine gluconate solutions having a concentration of from 0.5 to 1.3% by weight are suitable for use in the method of this invention, 1% solutions being particularly preferable.

The method of this invention is applicable to metal cutting surfaces of a wide variety of types. The term "cutting" is used herein to denote a transverse, rotary or shearing action which results in the separation of one piece of material fron another. Specifically, the method of this invention is applicable to knives, razor blades, saws, and microtomes, on the one hand and to cutting tools with formed cutting faces on the other hand, for example drills, taps and dies. With knives, the aforesaid useful restorative and/or protective effective is achieved irrespective of the manner of forming cutting edges, these usually being produced from thin strips of metal in Germany and from forgings in Great Britain and France. Specific further examples of cutting surfaces of the first aforesaid type to which the method of this invention is particularly applicable are razor blades made of carbon steel or stainless steel, scalpels, scissors, knives of carbon steel or stainless steel, garden and agricultural cutting implements, especially shears and mowing machines, blades used in machinery for cutting cloth, guillotines for cutting paper and logs of rolled tissue, blades of carpenters planes and paint and wallpaper scrapers.

When carrying out the method of this invention, the surface structure of the metal cutting surface which is treated is modified in such a manner that loosely adhering material such as rust may be removed from the metal surface in forming the aforesaid lath-like structures. It is preferred that the composition employed contains a surface active substance (surfactant) to clean the blade and dispel all such debris that has collected in the region of the cutting surface. Although both anionic and cationic surfactants may be employed, the use of cationic surfactants is preferred, especially when the cutting surface being treated belongs to an implement for surgical use or a razor blade. Cationic surfactants dissociate in solution into a relatively large and complex cation which is responsible for the surface activity and a smaller inactive anion. The cation usually contains a pentavalent nitrogen atom which is often present as a quaternary ammonium group. In addition to possessing the emulsifying and detergent properties usually associated with surface-active agents, cationic surfactants have marked bactericidal activity against both gram-positive and gram-negative organisms. Quaternary ammonium compounds are preferred for use with surgical instruments, in particular because, inter alia, they combine readily with proteins. Whilst they are bactericidal to gram-positive organisms, they are often relatively ineffective against some gram-negative organisms, although this defect may be remedied in some cases by use of higher concentrations. However, chlorhexidine compounds also possess topical antiseptic properties against a wide range of gram-positive and gram-negative organisms even when used in high dilution and do not inactivate quaternary ammonium surfactants, for exmple cetrimide, or sulphonamides. Moreover, as a result of using quaternary ammonium surfactants in combination with chlorhexidine compounds it is possible to achieve the particular benefits as aforesaid of the use of surfactants, coupled with the particular property of quaternary ammonium surfactants of being able to combine readily with proteins and move them from the surfaces of cutting instruments, and yet achieve a synergistic activity against bacteria so that the compositions employed are effective against the wide range of gram-positive and gram-negative organisms.

Cationic surfactants are most effective in neutral solution and, although they are reasonably stable to acids, their bactericidal activity is appreciably reduced in acid media. Their solutions are generally colourless, odourless, non-irritating and non-toxic in bactericidal concentrations, are stable for long periods and will withstand both boiling and autoclaving. Cationic surfactants are compatible with each other but are incompatible with soaps and other anionic surfactants since the oppositely charged complex ions tend to neutralise each other. Mutual precipitation results if the concentrations are sufficiently high. Soap in concentration as low as 0.1% by weight decreases the activity of cationic surfactants and to effect maximum bactericidal activity, it is essential to ensure that any surface to which a composition of this invention containing a cationic surfactant is applied is freed from soap.

Examples of preferred cationic surfactants for use in the practice of this invention are the following: benzalkonium halides, especially bromides or chlorides, for example benzethonium chloride and methylbenzethonium chloride, cetrimonium bromide, cetylpyridinium bromide, cetylpyridinium chloride, chlorphenoctium amsonate, dequalinium acetate, dequalinium chloride, domiphen bromide, halopenium chloride, laurolinium acetate, myristyl-gamma-picolinium chloride, triclobisonium chloride and cetrimide. Cetrimide is the preferred cationic surfactant for use in the practice of this invention. The cationic surfactant may be used in a concentration of from 0.5 to 4% by weight, preferably about 3% by weight.

The length of time during which the cutting surface of a tool to be treated by the method of this invention will remain in contact with the chlorhexidine compound-containing composition will depend upon the concentration of the chlorhexidine compound. Usually a treatment time of from 15 minutes to 24 hours will suffice. Since the prolonged immersion there is a possibility that some rusting will occur and, under the conditions of low oxygen availability, the oxide coating formed will be tightly adhering to the metal surface and of a type not readily removed, or prevented from adhering, by the presence of the chlorhexidine compound, it is preferred that when prolonged immersion in a chlorhexidine salt solution is to take place, the salt solution contain sodium nitrite in a concentration of up to 1% by weight, preferably 0.1%, to prevent such rust formation. Alternatively, it is possible to use a mixture of equal parts by weight of sodium nitrite and sodium carbonate.

Figure 7:
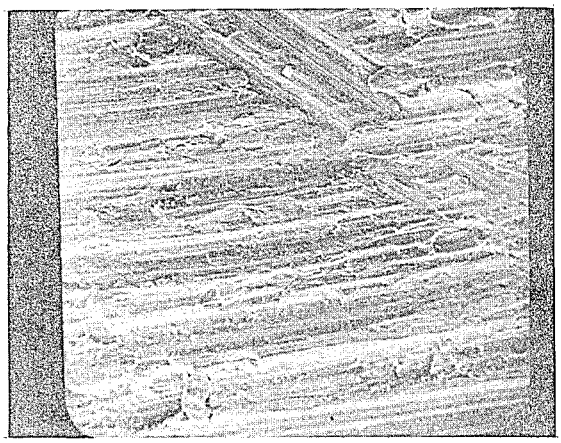
Figure 8:
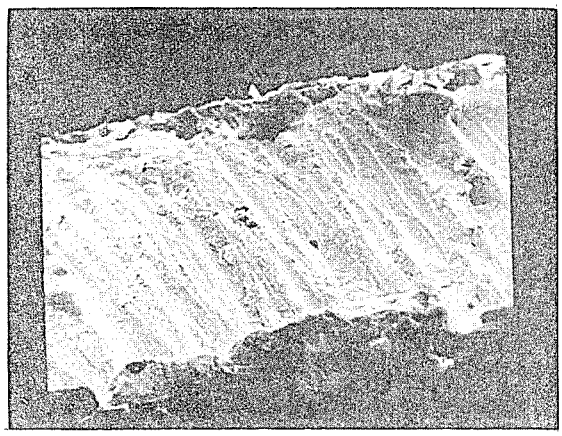
Figure 9:
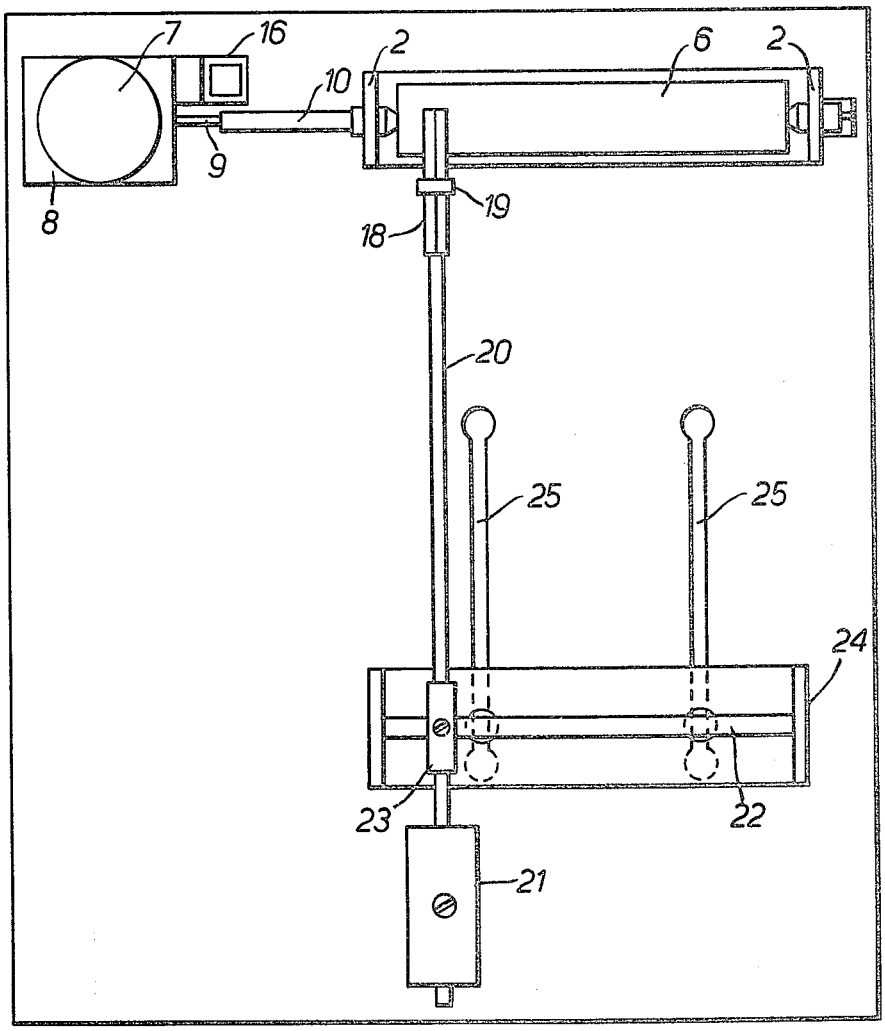
Figure 10:
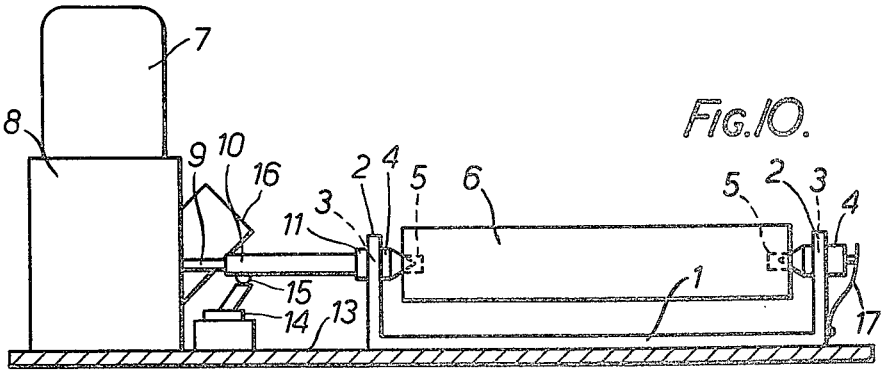

For a better understanding of the invention and to show how the same may be carried into effect, reference will now be made by way of example only to the accompanying drawings, wherein:

FIGS. 1 to 8 are photomicrographs of a variety of cutting surfaces and illustrative the behaviour of the metal at the cutting surfaces when brought into contact with a chlorhexidine gluconate solution; and FIGS. 9 and 10 are elevational and plan views respectively of apparatus for use in the testing of cutting surfaces for their cutting efficiency.

Figure 2:
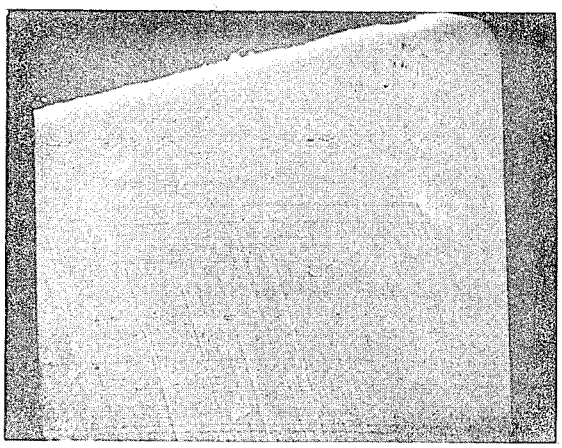
Figure 3:
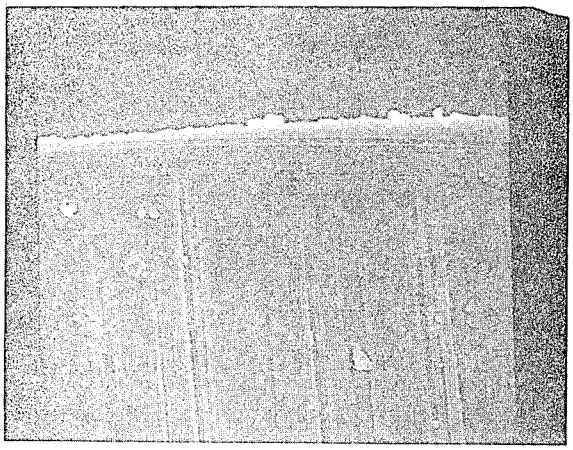
Figure 4:
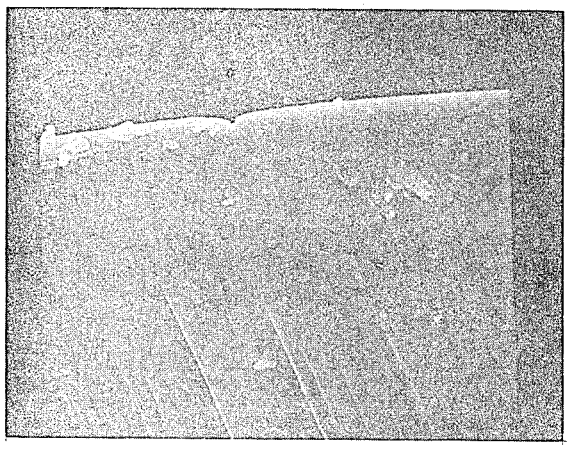

Thus, referring to the drawings, FIGS. 1 to 4 are stereoscans produced using a Cambridge Instruments stereoscan, of cheap carbon steel razor blades. FIG. 1 shows the cutting edge of a brand new blade which has not been treated with a chlorhexidine salt-composition; FIG. 2 shows the blade after treatment with a chlorhexidine salt composition, but before use of the blade; FIG. 3 shows the condition of a used blade treated with a chlorhexidine salt solution, after subjection to re-use; and FIG. 4 shows by way of comparison, a specimen carbon steel blade of like type which has been subjected to the same amount of use as the blade of FIG. 3, but which was not subjected to treatment with a chlorhexidine salt-composition before use. Each of the stereoscan photographs is to a magnification of 770 and each of the specimens, other than that shown in FIG. 1, was ultrasonically cleaned before treatment or treatment and use. As can be seen from FIG. 1, the blade surface is relatively smooth adjacent the edge and the blade edge itself appears as a relatively smooth line. In FIG. 2 a white material can be seen to extend around the edge region and structures of a lath-like nature can be seen to extend under blade 7. In FIG. 3, the saw toothing which forms at the blade edge during the use thereof while untreated has been largely occupied by the uni-molecular layer as aforesaid thereby filling out the blade edge and retaining the blade edge during the subsequent use. FIG. 3 should be contrasted with FIG. 4 which shows deep notch formation along the edge of the cutting surface.

Figure 5:
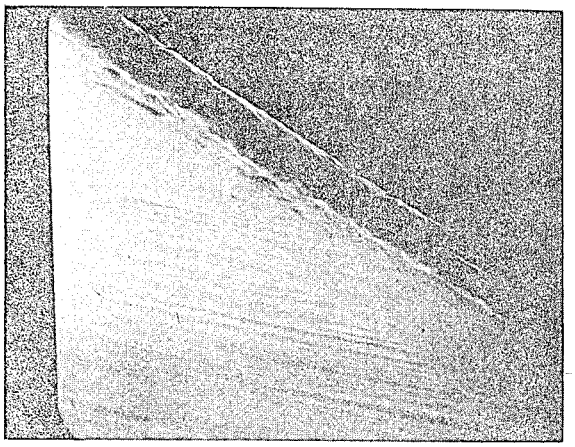

Referring next to FIG. 5 of the drawings there is shown a stereoscan of the edge region of a razor blade which has been treated by the method of this invention. Over the major part of the blade edge exists a unimolecular formation which protects the blade edge. During handling, this structure has been partially broken away to reveal the normal blade edge therebelow (see right-hand edge portion).

Figure 6:
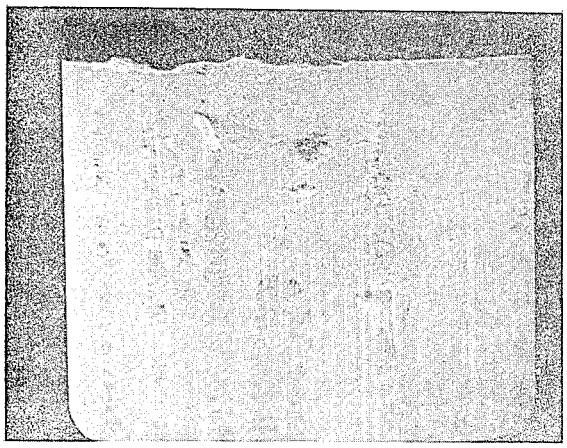

FIG. 6 shows a pencil sharpener blade formed from a cast ingot treated according to this invention and magnified by 700 times. The blade which has already been subjected to use can be seen to possess marked lath-like formations on the surface thereof and modification of the free edge region.

FIG. 7 of the accompanying drawings is a stereoscan×140 of a scissor blade which has been treated by the method of this invention. Here, the lath-like formations are particularly intensively formed. Finally, referring to FIG. 8 of the drawings, there is shown a stereoscan of a knife edge×350. The formation of lath-like structures (light coloured) can readily be distinguished from the base metal which appears darker coloured.

Referring finally to FIGS. 8 and 9, there is shown apparatus for use in testing the cutting efficiency of a cutting blade. The apparatus comprises a support member 1 having a pair of upstanding brackets 2 each of which is formed with an aperture 3 therethrough each of which houses a centering peg 4. The centering pegs 4 enter axial recesses 5 in the ends of a rod 6 formed of nylon 6. Situated adjacent the support member is a motor 7 surmounting a gearbox 8 from which extends a drive rod 9 coupled by means of a coupling member 10 to a drive peg 11 which enters a recess in one end of one peg 4. The gearbox 8 and support member 1 are both mounted on a base plate 13 on which is additionally mounted a microswitch 14 having an actuating stud 15 for effecting actuation of coupling of the drive rod 9 to the driving peg 11. Situated adjacent the coupling is a rev counter 16 for counting the number of revolutions made by the drive rod. A pressure spring 17 acts on one of the centering pegs 4 so as to constrain the rod 6 to remain between the two centering pegs.

Situated over the nylon rod 6 is a clamping arrangement comprising a slotted brass rod 18 around which is fixed a clamping member 19 in which a blade (not shown) to be tested is fitted with a portion thereof below the rod. The brass rod 18 is connected through a blade clamp arm 20 to a counterweight 21, passing over a pivot rod 22 to which it is affixed by means of a clamp 23. The pivot rod 22 is mounted on a pivot support device 24 which is capable of sliding movement in a pair of slots 25 for effecting adjustment of the pivot.

The following examples illustrate this invention:

EXAMPLE 1

An aqueous solution was prepared containing 1% by weight of cetrimide, 0.02% by weight chlorhexidine gluconate, 7% by weight of isopropyl alcohol, and small amounts of tartrazine (as colouring agent) and perfume. This solution was suitable for use in the restoration of blunted razor blades. Used razor blades of the type shown in FIG. 2 and which had been used, untreated, until they had become too uncomfortable to use were immersed in this solution for 20 minutes. After such treatment, they could be used in comfort for up to 65% of their original useful life.

EXAMPLE 2

The procedure of Example 1 was repeated, but using in place of the chlorhexidine gluconate in the there stated concentration the chlorhexidine salts indicated in the following Table in the concentrations set out therein. In each case, formation of a protective layer on the cutting surface was observed and the useful life of the blades was prolonged:

TABLE I

| Salt | % w/v |
|---|---|
| Dihydriodide | 0.1 |
| Dihydrochloride | 0.06 |
| Dihydrofluoride | 0.5 |
| Diperchlorate | 0.1 |

TABLE I-continued

| Salt | % w/v |
|---|---|
| Dinitrate | 0.03 |
| Dinitrite | 0.08 |
| Sulphate | 0.01 |
| Sulphite | 0.02 |
| Thiosulphate | 0.01 |
| Di-acid phosphate | 0.03 |
| Difluorophosphate | 0.04 |
| Diformate | 1.0 |
| Diacetate | 1.8 |
| Diproprionate | 0.4 |
| Di-isobutyrate | 1.3 |
| Di-n-valerate | 0.7 |
| Dicaproate | 0.09 |
| Malonate | 0.02 |
| Succinate | 0.02 |
| Malate | 0.04 |
| Tartrate | 0.1 |
| Dimonoglycolate | 0.08 |
| Monodiglycolate | 2.5 |
| Dilactate | 1.0 |
| Di-alpha-hydroxyisobutyrate | 1.3 |
| Digluconate | .7 |
| Diglucoheptonate | .7 |
| Dimethanesulphonate | 1.2 |
| Di-isothionate | .5 |
| Dibenzoate | 0.03 |
| Dicinnamate | 0.02 |
| Dimandelate | 0.06 |
| Di-isophthalate | 0.008 |
| Di-2-hydroxynaphthoate | 0.014 |
| Embonate | 0.0009 |

EXAMPLE 3

An aqueous solution was prepared containing 3% by weight of cetrimide, 1% by weight of chlorhexidine gluconate, 7% by weight of isopropyl alcohol and small amounts of tartrazine (as colouring agent) and perfume. This solution was employed in the testing of a variety of razor blades using the apparatus shown in FIGS. 9 and 10.

In each experiment, there was used one or two speciments of a particular type of blade, each experimental blade treated with the aforesaid solution being compared for its cutting life with a similar untreated blade.

In the experiment, the test apparatus was driven by the motor 7 (low voltage d.c.) running at 6000 r.p.m. and coupled to the gearbox 8 with a speed ratio of about 100:1. A transformer/rectifier unit (not shown) made it possible to operate from 240 volts a.c. mains and to vary the final drive speed of the nylon rod 6 from about 60 r.p.m. to 90 r.p.m. The digital counter 16 operated to indicate the number of revolutions executed by the rod 6.

The nylon rod 6 was employed as an abrading element. It was 1 inch in diameter and 5 inches long. As a preliminary step in each test, the blades, split longitudinally if double edged, were held in the clamp 19 on the brass rod 18 at the end of the blade clamp arm 20. A 150 gram counterweight 21 was attached by means of a screw to the opposite end of the blade clamp arm. The position of the pivot rod 22 for balance with the blade just touching the rod 6 was determined by loosening of the clamp 23 and sliding of the pivot support device 24 until balance was achieved. The blade clamp arm was then clamped to the pivot rod by means of the clamp 23.

Each test blade was initially subjected to a standard wearing operation prior to testing for cutting purposes. Thus before each cutting operation, including a first cutting operation, the rod 6 was rotated fifty times with the blade resting lightly thereon. Rotation of the rod 6 was then stopped, a sheet of paper, the same paper being used in each case, was placed under the blade and after placing a 50 gram weight on the blade, the weight engaging with the slot in the brass rod 18, the paper was drawn away from the blade at an angle of about 20° to the horizontal. After each cutting operation, the 50 gram weight was removed and the rod 6 rotated a further 50 times with the blade in contact therewith. Before positioning of a sheet of paper under the blade, debris was carefully brushed away.

Testing was continued until each particular blade failed to cut a sheet of paper. In the table which follows are set out the number of times a particular blade was able to cut the sheet of paper. In some of the tests, the standard 50 gram load on the blade was increased and generally the cutting effiency of the blade was correspondingly decreased.

TABLE II

| Test Blade[1] | Blade load in excess of standard load | Number of times paper cut | |
|---|---|---|---|
| | | Untreated | Treated |
| 1 Gillette Platinum | | | |
| 1st run | — | 3 | 16 |
| 2nd run | — | 4 | 17 |
| 3rd run | — | 1 | 25 |
| 2 Gillette GII | | | |
| 1st run | — | 1 | 17 |
| 2nd run | — | 1 | 14 |
| 3rd run | — | 1 | 20 |
| 4th run | — | 2 | 9 |
| 3 Gillette Platinum | | | |
| 1st run | 100 g | 1 | 8 |
| 2nd run | 100 g | 2 | 8 |
| 4 Gillette GII (all blades from same cartridge) | | | |
| 1st run | 100 g | 0 | 3 |
| 2nd run | 100 g | 0 | 3 |
| 5 Gillette GII | | | |
| 1st run | 60 g | 0 | 3 |
| 2nd run | 60 g | 0 | 3 |
| 6 Gillette Platinum | 60 g | 1 | 25 |
| 7 Gillette Platinum | 100 g | 5 | 45[2] |
| 8 Wilkinson Sword[3] | | | |
| 1st run | — | 1 | 9 |
| 2nd run | — | 1 | 12 |
| 9 Wilkinson Sword | | | |
| 1st run | — | 2 | 18 |
| 2nd run | — | 2 | 24 |
| 3rd run | — | 1 | 20 |
| 4th run | — | 2 | 22 |
| 10 Wilkinson Sword*** | | | |
| 1st run | — | 1 | 12 |
| 2nd run | — | 1 | 14 |
| 11 Wilkinson Sword[3] | | | |
| 1st run | 60 g | 1 | 10 |
| 2nd run | | 2 | 12 |
| 12 Wilkinson Sword | | | |
| 1st run | 60 g | 2 | 16 |
| 2nd run | 60 g | 1 | 10 |
| 13 Wilkinson Close and Ease Disposable Razor using single blade therefrom | | | |
| 1st run | -- | 2 | 18 |
| 2nd run | — | 1 | 16 |
| 3rd run | — | 0 | 10 |
| 14 Wilkinson Close and Easy Razor blade | | | |
| 1st run | — | 5 | 50 |
| 2nd run | — | 4 | 42 |
| 15 BIC Disposable Razor | — | 5 | 20 |
| 16 Lames (Tunisia) | | | |
| 1st run | — | 0 | 5 |
| 2nd run | — | 0 | 4 |
| 3rd run | — | 0 | 7 |

TABLE II-continued

| Test Blade[1] | Blade load in excess of standard load | Number of times paper cut | |
|---|---|---|---|
| | | Untreated | Treated |
| 4th run | — | 0 | 6 |
| 5th run | — | 0 | 4 |
| 17 Super Sabah (Tunisia) | | | |
| 1st run | — | 1 | 10 |
| 2nd run | — | 1 | 12 |
| 3rd run | — | 1 | 14 |
| 4th run | — | 0 | 12 |
| 5th run | — | 1 | 9 |
| 6th run | — | 2 | 10 |
| 7th run | — | 0 | 12 |
| 8th run | — | 1 | 12 |
| 18 MTB Lame African (Tunisia) | | | |
| 1st run | — | 2 | 10 |
| 2nd run | — | 3 | 11 |
| 3rd run | — | 1 | 9 |
| 4th run | — | 1 | 13 |
| 19 Boots Super Stainless | | | |
| 1st run | — | 1 | 20 |
| 2nd run | — | 1 | 17 |
| 3rd run | — | 1 | 19 |
| 4th run | — | 1 | 16 |
| 5th run | — | 1 | 18 |
| 6th run | — | 2 | 2[4] |
| 7th run | — | 1 | 5 |
| 8th run | — | 1 | 9 |
| 20 Sigma Proton (Japan) | — | 2 | 30 |
| | — | 3 | 32 |
| 21 Neo Proton (Japan) | — | 9 | 63 |
| | — | 8 | 49 |

[1]Blades of same type but from packs bought at different locations used in different runs, unless otherwise indicated. Blades from some packs used for test and comparative purposes.
[2]Heel and toe experiment in which blade immersed at angle in test solution so that part of cutting surface remained untreated.
[3]Double edge blade split longitudinally, the two halves of respective blades being used in the two runs.
[4]Thought to indicate use of inherently damaged (blunt) blade.

EXAMPLE 4

Tests were carried out using mild steep cutting blades normally employed in the cutting of Idem (Registered Trade Mark) non carbon copying paper. Each sheet of this paper is formed of the following layers:

paper
China clay
microcapsules encapsulating a colouring dye
China clay
paper

In view of the composition of the paper, it is not surprising that this paper will blunt the edge of a cutting blade very quickly. Two cutting blades are employed in machines used for cutting Idem. These have to be sharpened in normal use when employing four layers of Idem at a time, every five days.

Two of these blades which had ceased to cut effectively were treated with the chlorhexidine gluconate solution employed in Example 3 and replaced in the machine. The blades were 7 ft. 6 inches in length, 1 inch thick tapering to a knife edge up to 2 inches and weighed about 40 pounds each.

It was found that, after this treatment, the blades could be employed to good effect in cutting eight thicknesses of Idem instead of four for five weeks.

EXAMPLE 5

Kitchen rolls and toilet rolls are cut from logs of rolled paper 8 ft. in length representing the as manufactured form. Each log is perforated and contains 280 to 300 perforated portions of paper. These logs of paper have to be cut into appropriate lengths, for example 12 inches or 4½ inches depending on whether kitchen rolls or toilet rolls are being produced. The blade which is employed to cut the logs into the individual rolls is normally a mild steel blade and is 8 ft. in length.

Because it cuts toilet and kitchen rolls at a speed of 30 per minute and because of the heat generated by this cutting and the pressure required, the blade has to be sharpened every 10 minutes since otherwise very severe tearing will occur resulting in the loss of many kitchen or toilet rolls. This constant sharpening requires there to be available a team of fitters to remove blades for sharpening and effect sharpening thereof. Moreover, because of this constant sharpening, many blades are employed.

Blades of such type in use at premises of Bowater Scott Corporation Limited at Croydon, Surrey, England, which blades had ceased to be effective, were treated with the chlorhexidine gluconate solution employed in Example 3. The length of time the blades could then be employed was thereby increased from about 10 minutes to 7 hours representing a great saving in steel and labour costs.

I claim:

1. A method of protecting a metal cutting surface as ground which comprises applying to the cutting surface an amount sufficient to protect said metal cutting surface of a chlorhexidine compound dispersed or dissolved in a carrier therefor and for a predetermined time sufficient for said chlorhexidine compound to interact with said metal cutting surface to protect said metal cutting surface, whereby the effective life of the ground cutting surface is prolonged.

2. A method as claimed in claim 1, wherein the chlorhexidine compound is dissolved in water and the cutting surface is immersed in the solution thereby formed.

3. A method as claimed in claim 1, wherein the chlorhexidine compound is incorporated in a gel or cream applied to the cutting surface and allowed to stand thereon.

4. A method as claimed in claim 1, wherein the chlorhexidine compound is present in the carrier in a concentration of from 0.001 to 3% by weight.

5. A method as claimed in claim 1, wherein the chlorhexidine compound is a chlorhexidine salt.

6. A method as claimed in claim 5, wherein the chlorhexidine salt is chlorhexidine digluconate.

7. A method as claimed in claim 5, wherein an aqueous chlorhexidine digluconate solution having a concentration of from 0.5 to 1.3% by weight is employed.

8. A method as claimed in claim 1, which is applied to a cutting edge of a razor blade.

9. A method as claimed in claim 1, which is applied to a cutting edge of a paper cutting blade.

10. A method of restoring a used cutting surface of a razor blade, which comprises bringing the cutting surface into contact with an amount sufficient to restore said metal cutting surface of a chlorhexidine compound dispersed or dissolved in a carrier therefor, which carrier has dispersed therein a surfactant.

11. A method as claimed in claim 10, wherein the chlorhexidine compound is dissolved in water and the cutting surface is immersed in the solution thereby formed.

12. A method as claimed in claim 10, wherein the chlorhexidine compound is present in the carrier in a concentration of from 0.001 to 3% by weight.

13. A method as claimed in claim 10, wherein the chlorhexidine compound is selected from the group consisting of the dihydroiodide, dihydrochloride, dihydrofluoride, sulphate, sulphite, thiosulphate, di-acid phosphate, difluorophosphate, diformate, diisobutyrate, succinate, dimonoglycolate, monodiglycolate, dilactate, di-alpha-hydroxy isobutyrate, digluconate, diglucoheptonate, dimethanesulphonate, diisothionate, dibenzoate, dicinnamate and dimandelate salts of chlorhexidine.

14. A method as claimed in claim 13, wherein an aqueous chlorhexidine digluconate solution having a concentration of from 0.5 to 1.3% by weight is used.

15. A method as claimed in claim 10, wherein the surfactant is a cationic surfactant.

16. A method as claimed in claim 15, wherein the surfactant is a quaternary ammonium compound.

17. A method as claimed in claim 16, wherein the surfactant is cetrimide.

18. A method as claimed in claim 15, wherein the surfactant is present in a concentration of from 0.5 to 4% by weight.

19. A method as claimed in claim 10, wherein the chlorhexidine compound is dissolved in carrier which contains a rust inhibitor selected from the group consisting of sodium nitrite and sodium nitrite/sodium carbonate mixtures of equal parts by weight, which rust inhibitor is present in a concentration of up to 1% by weight.

20. A method as claimed in claim 10, wherein said predetermined period lasts for from 15 minutes to 24 hours.

21. A method of restoring a used cutting surface of a paper cutting knife, which comprises bringing the cutting surface into contact with an amount sufficient to restore said cutting surface of a solution or dispersion of a chlorhexidine compound, which solution or dispersion has dispersed therein a surfactant.

22. A method as claimed in claim 21, wherein the paper cutting knife is immersed in an aqueous solution containing chlorhexidine digluconate in a concentration of from 0.01 to 3% by weight and a quaternary ammonium compound as cationic surfactant.

23. A method as claimed in claim 22, wherein the surfactant is cetrimide.

24. A method as claimed in claim 23, wherein the surfactant is present in a concentration of from 0.5 to 4% by weight.

25. A method of restoring a used cutting edge of a drill bit, which comprises bringing the cutting edge into contact with an amount sufficient to restore said cutting edge of a solution or dispersion of a chlorhexidine compound, which solution or dispersion has dispersed therein a surfactant.

26. A method as claimed in claim 25, wherein the cutting edge of a drill bit is immersed in an aqueous solution containing chlorhexidine digluconate in a concentration of from 0.1 to 3% by weight and a quaternary ammonium compound as cationic surfactant.

27. A method as claimed in claim 26, wherein the surfactant is cetrimide.

28. A method as claimed in claim 27, wherein the surfactant is present in a concentration of from 0.5 to 4% by weight.

29. A method of restoring a cutting surface of a garden or agricultural cutting implement, which comprises bringing the cutting surface into contact with an amount sufficient to restore said cutting surface of a solution or dispersion of a chlorhexidine compound, which solution or dispersion has dispersed therein a surfactant.

30. A method as claimed in claim 29, wherein said cutting surface is brought into contact with an aqueous solution of chlorhexidine digluconate having a concentration of 0.001 to 3% by weight and containing a cationic surfactant in a concentration of from 0.5 to 4% by weight.

31. A method as claimed in claim 30, wherein the surfactant is cetrimide.

32. A method as claimed in claim 30, wherein said cutting surface is brought into contact with an aqueous solution of chlorhexidine digluconate having a concentration of 0.001 to 3% by weight and containing a cationic surfactant in a concentration of from 0.5 to 4% by weight.

33. A method as claimed in claim 32, wherein the surfactant is cetrimide.

34. A method of restoring a cutting surface of a tap, which comprises bringing the cutting surface into contact with an amount sufficient to restore said cutting surface of a solution or dispersion of a chlorhexidine compound, which solution or dispersion has dispersed therein a surfactant.

35. A method as claimed in claim 34, wherein said cutting surface is brought into contact with an aqueous solution of chlorhexidine digluconate having a concentration of 0.001 to 3% by weight and containing a cationic surfactant in a concentration of from 0.5 to 4% by weight.

36. A method as claimed in claim 35, wherein the surfactant is cetrimide.

37. A method of restoring a cutting surface of a die, which comprises bringing the cutting surface into contact with an amount sufficient to restore said cutting surface of a solution or dispersion of a chlorhexidine compound, which solution or dispersion has dispersed therein a surfactant.

* * * * *